US008562289B2

(12) United States Patent
Kobayashi

(10) Patent No.: US 8,562,289 B2
(45) Date of Patent: Oct. 22, 2013

(54) METHOD AND SYSTEM FOR A LEAKAGE CONTROLLED FAN HOUSING

(75) Inventor: Sukeyuki Kobayashi, Loves Park, IL (US)

(73) Assignee: GE Aviation Systems, LLC, Grand Rapids, MI (US)

( * ) Notice: Subject to any disclaimer, the term of this patent is extended or adjusted under 35 U.S.C. 154(b) by 910 days.

(21) Appl. No.: 12/714,080

(22) Filed: Feb. 26, 2010

(65) Prior Publication Data

US 2011/0211942 A1 Sep. 1, 2011

(51) Int. Cl.
*F01D 11/08* (2006.01)

(52) U.S. Cl.
USPC ..... 415/173.1

(58) Field of Classification Search
USPC ..... 416/174; 415/170.1, 171.1, 173.1, 415/173.5, 174.5, 220
See application file for complete search history.

(56) References Cited

U.S. PATENT DOCUMENTS 4,295,787 A * 10/1981 Lardellier ..... 415/197
4,573,867 A 3/1986 Hand
4,621,520 A 11/1986 Schwarz et al.
4,738,586 A * 4/1988 Harter ..... 415/173.5
6,146,089 A 11/2000 Allen et al.
6,499,948 B1 * 12/2002 Iyer et al. ..... 415/220
7,125,223 B2 10/2006 Turnquist et al.
7,246,419 B2 7/2007 White
7,341,425 B2 * 3/2008 Murooka et al. ..... 415/170.1
2003/0235495 A1 * 12/2003 Rivers ..... 415/173.3
2009/0165540 A1 7/2009 Craig

* cited by examiner

*Primary Examiner* — Nathaniel Wiehe
*Assistant Examiner* — Adam W Brown
(74) *Attorney, Agent, or Firm* — Armstrong Teasdale LLP

(57) ABSTRACT

A method and system for a fan assembly that includes a fan casing having a longitudinal centerline axis extending from an upstream inlet opening to a downstream outlet opening is provided. The fan assembly also includes a first substantially cylindrical casing segment extending circumferentially about and substantially axially aligned with tips of a plurality of blades extending from a rotor hub, the first casing segment including a first inner diameter that is greater than the rotor diameter, a second casing segment configured to extend axially in a direction opposite a flow of fluid through the fan casing, the second casing segment including a second inner diameter, the second inner diameter less than the first inner diameter and the rotor diameter, and a third casing segment including the first inner diameter along a first circumferential edge, the second inner diameter along a second circumferential edge, and a surface extending therebetween.

16 Claims, 4 Drawing Sheets

METHOD AND SYSTEM FOR A LEAKAGE CONTROLLED FAN HOUSING

BACKGROUND OF THE INVENTION

The field of the invention relates generally to gas turbine engines, and more specifically, to a method and assembly for reducing blade tip leakage in gas turbine engines.

To maintain fan airflow performance in at least some known gas turbine engines, a clearance between impeller blades of the fan and a housing or casing of the fan is set to a close distance. The tight clearance facilitates preventing reverse flow leakage around the blade tips through the tip clearance. Higher air pressure downstream of the fan impeller tends to drive the flow back toward upstream, and this is observed at the tip clearance.

In some operating conditions, such as, but not limited to, extreme operating conditions, the close clearance may result in blade-housing interference and led to failures of fan components in the field. Such interference has been addressed by trimming the blade tips to increase the clearance. However, increasing the clearance increases leakage flow around the blade tips and reduces the performance of the fan assembly. The impact on fan performance is two-fold: Reduced impeller working area and increased tip clearance that will allow flow leakage the opposite direction to the main flow. The loss in performance caused by the former can be regained to some extent by adjusting blade pitch angles, for example, by twisting the tip of each blade and letting the rest of the blade span follow.

BRIEF DESCRIPTION OF THE INVENTION

In one embodiment, a fan assembly includes a fan casing having a longitudinal centerline axis extending from an upstream inlet opening to a downstream outlet opening. The fan assembly also includes a rotor including a hub and a plurality of rotor blades extending radially outward from the hub, the plurality of rotor blades each including a leading edge and a trailing edge in a direction of fluid flow through the fan casing, and a blade tip at a radially distal end of the blade, the tips of the plurality of rotor blades defining a rotor diameter, the rotor configured to rotate about the centerline axis. The fan assembly further includes a first substantially cylindrical casing segment extending circumferentially about and substantially axially aligned with the blade tips, the first casing segment including a first inner diameter that is greater than the rotor diameter, a second substantially cylindrical casing segment configured to extend axially in a direction opposite a flow of fluid through the fan casing, the second casing segment including a second inner diameter, the second inner diameter less than the first inner diameter and the rotor diameter, and a third casing segment extending between the first and second casing segments, the third casing segment including the first inner diameter along a first circumferential edge, the second inner diameter along a second circumferential edge, and a surface extending therebetween.

In another embodiment, a method of forming a casing for a rotatable member includes forming a first casing segment having a first inner diameter, the first inner diameter selected to be greater than an outer diameter of the rotatable member, forming a second casing segment having a second inner diameter, the second inner diameter selected to be less than the outer diameter, and forming a step segment including a first circumferential edge adjacent the first casing segment and a second circumferential edge adjacent the second casing segment and a surface extending between the first edge and the second edge, the first edge having the first inner diameter and the second edge having the second inner diameter.

In yet another embodiment, a fan casing having a longitudinal centerline axis extending from an upstream inlet opening to a downstream outlet opening includes a first substantially cylindrical casing segment configured to extend axially and radially outboard of a path of a blade tip, the first casing segment including a first inner diameter, a second substantially cylindrical casing segment configured to extend axially in a direction opposite a flow of fluid through the fan casing, the second casing segment including a second inner diameter, the second inner diameter less than the first inner diameter, and a third casing segment including a surface extending between the first and second casing segments, the third casing segment including the first inner diameter along a first circumferential edge and the second inner diameter along a second circumferential edge.

BRIEF DESCRIPTION OF THE DRAWINGS

FIG. 1 is a perspective view of a gas turbine engine in accordance with an exemplary embodiment of the present invention;

FIG. 2 is an axial view of the fan rotor shown in FIG. 1 in accordance with an exemplary embodiment of the present invention;

FIG. 3 is an enlarged side view of fan assembly 102; and

FIG. 4 is an enlarged side view of fan assembly 102 in accordance with an exemplary embodiment of the present invention.

DETAILED DESCRIPTION OF THE INVENTION

The following detailed description illustrates embodiments of the invention by way of example and not by way of limitation. It is contemplated that the invention has general application to providing enhanced sealing between rotating and stationary components in industrial, commercial, and residential applications.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Figure 1:
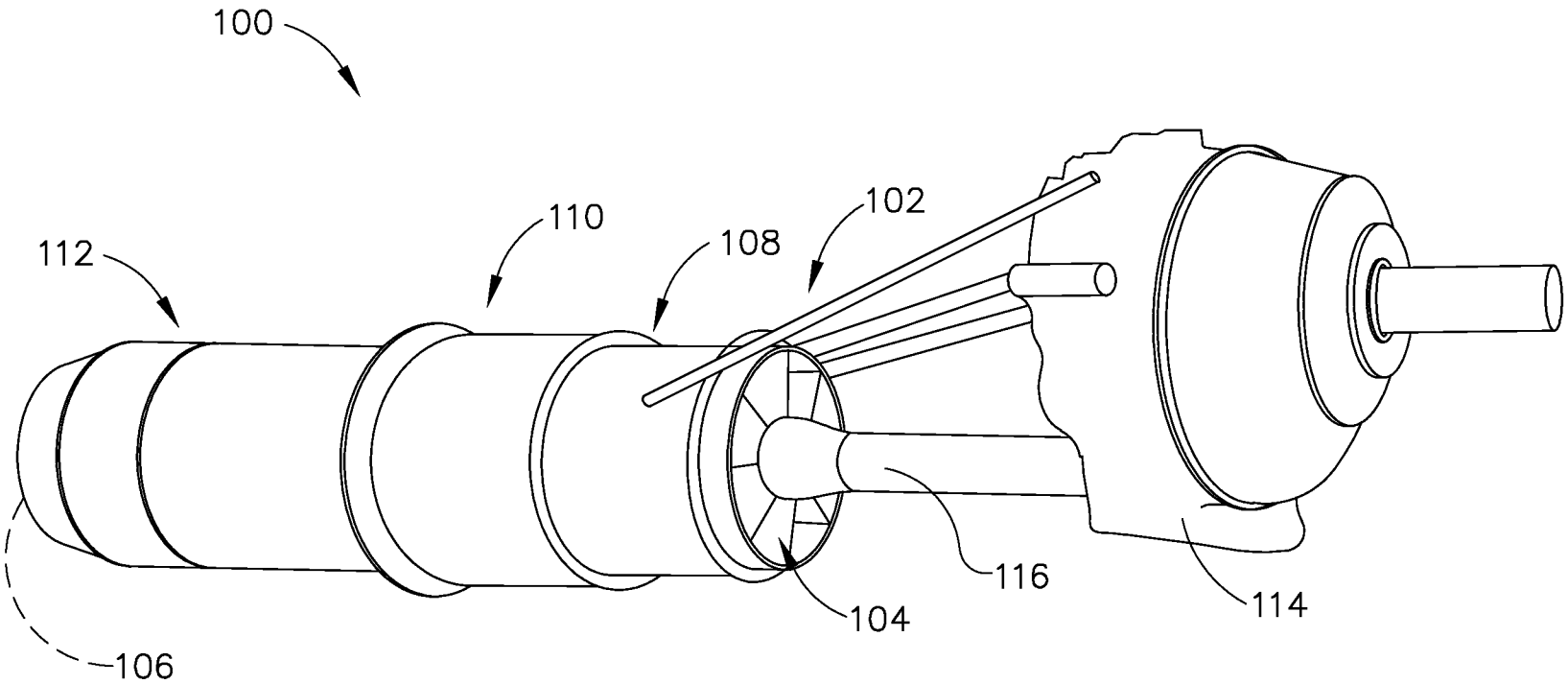
FIGS. 1-4 show exemplary embodiments of the method and assembly described herein.

FIG. 1 is a perspective view of a gas turbine engine 100 in accordance with an exemplary embodiment of the present invention. In the exemplary embodiment, gas turbine engine 100 includes a fan assembly 102 including a fan casing 104 and a fan rotor 106. Gas turbine engine 100 also includes in serial flow arrangement, a compressor section 108, a combustor section 110, and a turbine section 112. A propeller gearbox 114 is coupled to gas turbine engine 100 through a shaft 116 driven by at least one turbine in turbine section 112.

Figure 2:
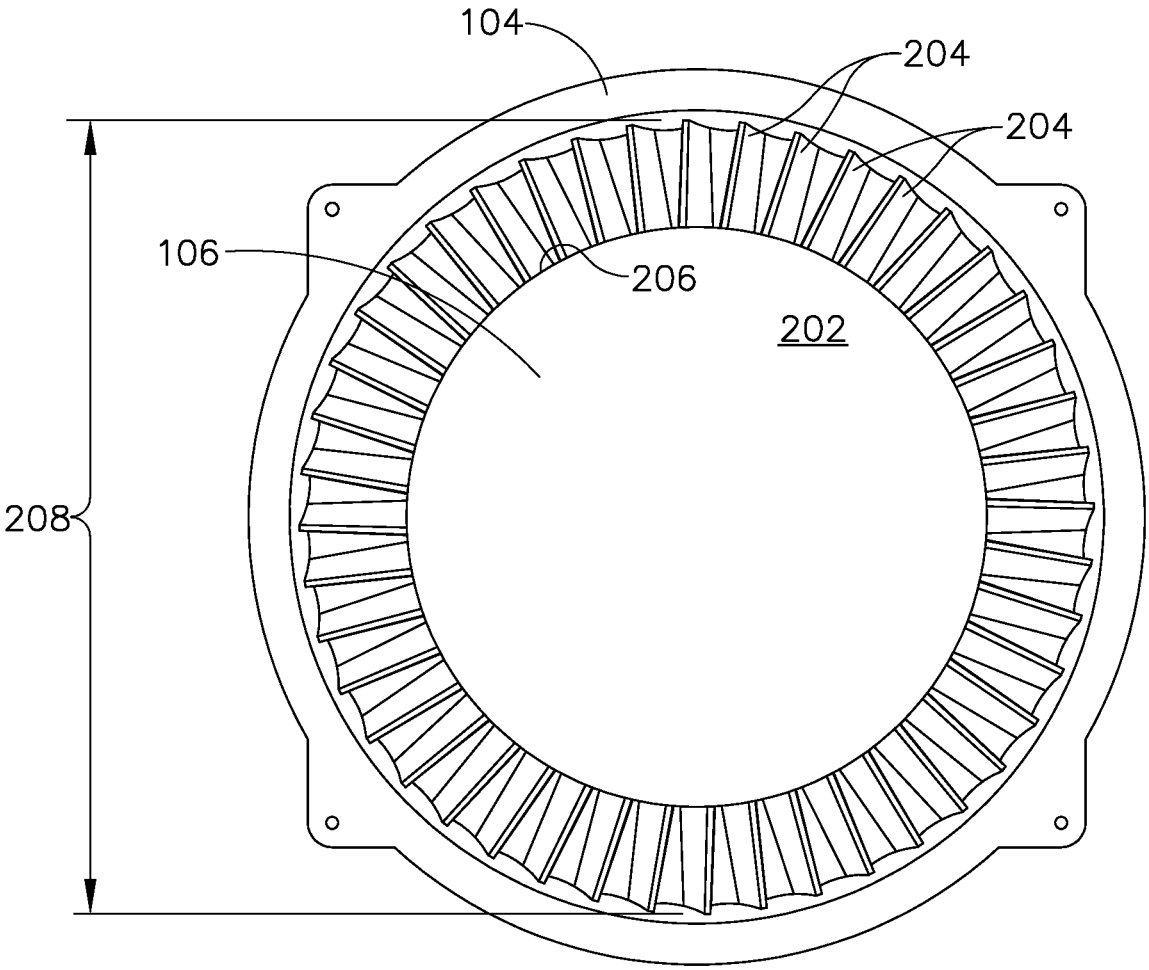

FIG. 2 is an axial view of fan rotor 106 and fan casing 104 (shown in FIG. 1) in accordance with an exemplary embodiment of the present invention. In the exemplary embodiment, fan rotor 106 includes a fan hub 202 having a plurality of fan blades 204 coupled to a radially outer periphery 206 of fan hub 202. Fan blades 204 extend radially outwardly from fan hub 202 and are spaced circumferentially about outer periphery 206. A fan rotor diameter 208 is defined by a distance between diametrically opposed fan blade tips.

Figure 3:
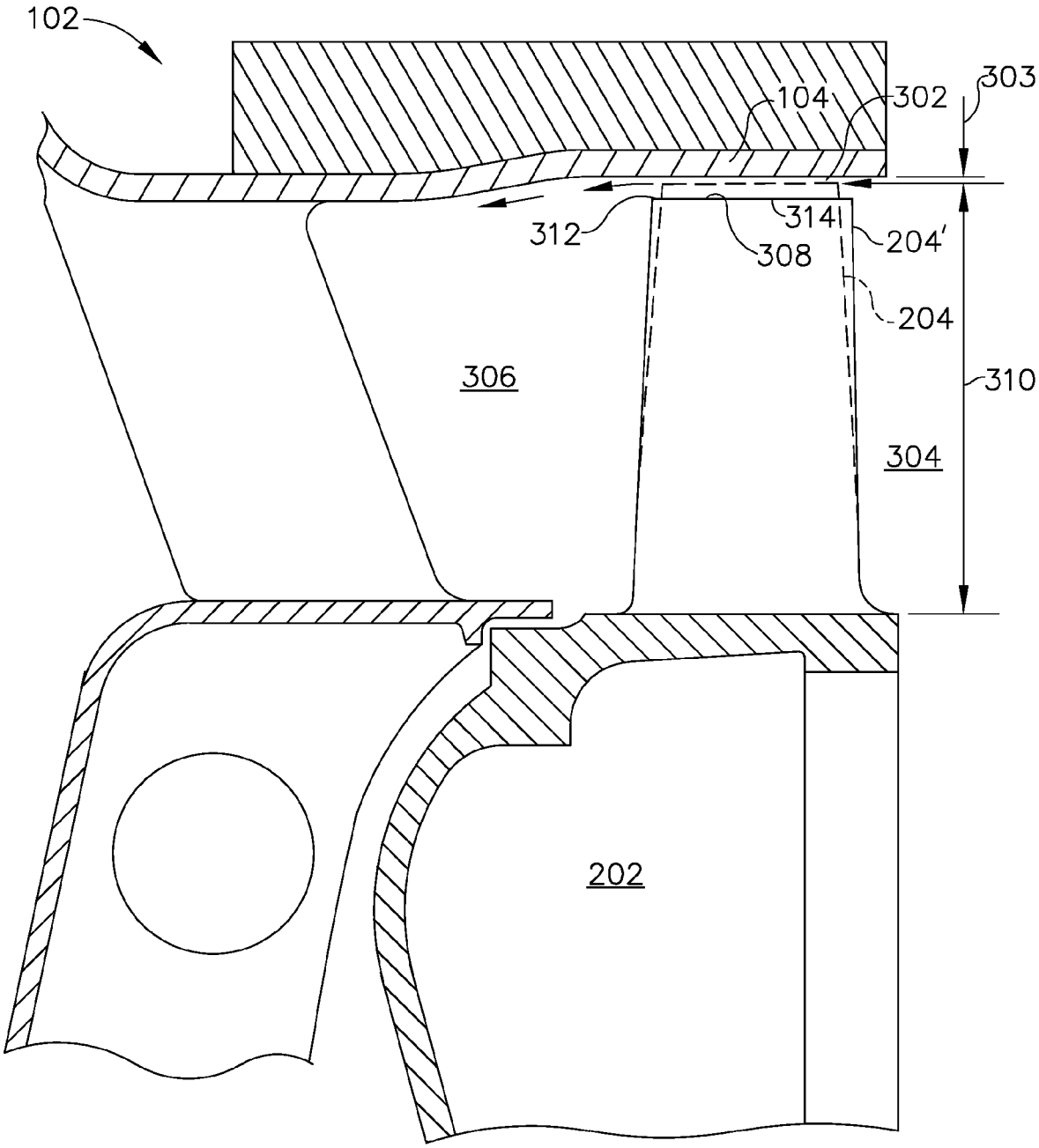

FIG. 3 is an enlarged side view of fan assembly 102 (shown in FIG. 1). In a first embodiment, a known casing 104 and a known blade 204 are illustrated. In the first embodiment, a gap 302 of distance 303 between blade 204 and casing 104 defines a relatively small leakage path from a downstream side 304 of blade 204 and an upstream side 306 of blade 204. Because of relatively small gap 302, a tip 308 of blade 204 may impact casing 104 causing damage to casing 104, blade 204, or both. To reduce a probability of such impact, a length 310 of blade 204 is reduced. Blade 204' illustrates a blade of reduced length 310'. Reducing length 310 increases a clearance 302 between a fan blade tip 308 of blade 204 and casing 104. However, the benefit of the greater clearance between blade 204' and casing 104 creates a larger leakage path around tip 314 reducing an efficiency of fan assembly 102.

Figure 4:
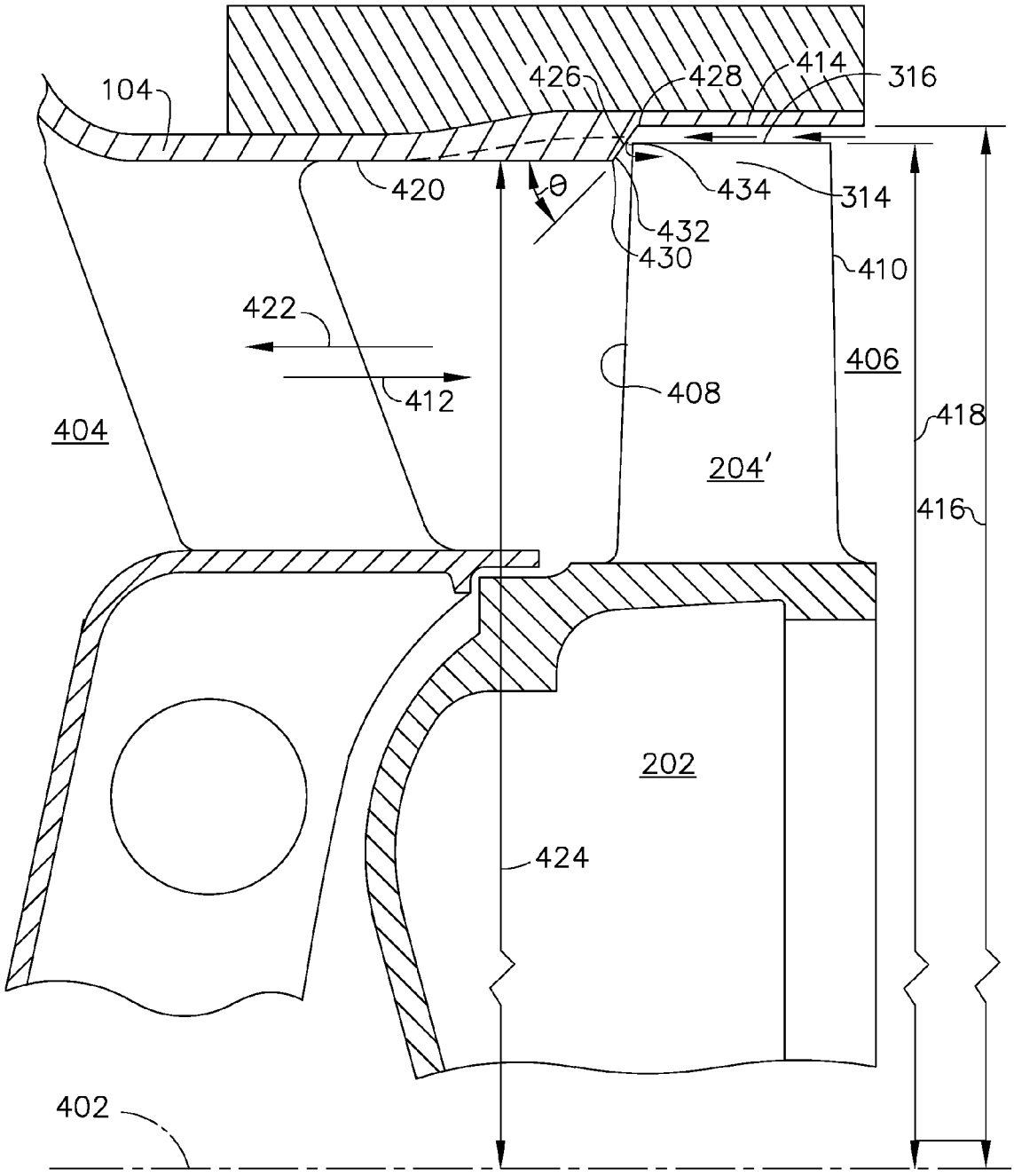

FIG. 4 is an enlarged side view of fan assembly 102 (shown in FIG. 1) in accordance with an exemplary embodiment of the present invention. In the exemplary embodiment, fan assembly 102 includes a longitudinal centerline axis 402 extending from an upstream inlet opening 404 to a downstream outlet opening 406. Fan assembly 102 includes fan rotor 106 that includes fan hub 202 a plurality of fan blades 204' extending radially outward from fan hub 202. Each rotor blade 204' includes a leading edge 408 and a trailing edge 410 in a direction 412 of fluid flow through fan assembly 102, and blade tip 314 at a radially distal end 316 of rotor blade 204'. A fan rotor diameter 418 is defined by a distance between diametrically opposed fan blade tips 314. Rotor 106 is configured to rotate about centerline axis 402.

Fan assembly 102 includes a housing or casing 104 that includes a first substantially cylindrical casing segment 414 extending circumferentially about and substantially axially aligned with blade tips 314. First casing segment 414 includes a first inner diameter 416 that is greater than rotor diameter 418. Fan assembly 102 includes a second substantially cylindrical casing segment 420 configured to extend axially in a direction 422 opposite a flow of fluid through fan assembly 102. Second casing segment 420 includes a second inner diameter 424 that is less than first inner diameter 416 and rotor diameter 418. Fan assembly 102 also includes a third casing segment 426 extending between first casing segment 414 and second casing segment 420. Third casing segment 426 includes first inner diameter 416 along a first circumferential edge 428, second inner diameter 424 along a second circumferential edge 430, and a surface 432 extending therebetween. Surface 432 is spaced apart from leading edge 408 of each blade 204' to form a leakage gap 434. Leakage gap 434 is sized to less than clearance 312. In the exemplary embodiment, surface 432 is illustrated as having a straight or conical profile between first circumferential edge 428 and second circumferential edge 430. However, in various embodiments, surface 432 is also formed in an arcuate profile, such as, but not limited to, convex, concave, or a more complex curvature. In various other embodiments, surface 432 is formed in an angular stepped profile. The curvature or stepped profiles may be shaped complementary to leading edge 408 to shape leakage gap 434 to a predetermined shape for optimizing leakage flow characteristics or to minimize the leakage flow.

In various embodiments, fan casing 104 is fabricated unitarily using a casting process. That is rather than forming fan casing 104 is separate pieces and joining the separate pieces together, fan casing 104 is formed as a single cast unit that may, in some embodiments, be finally machined to tightly controlled specifications. In various embodiments, fan casing 104 is fabricated from aluminum or an aluminum alloy.

During operation, a pressure differential is generated across fan rotor 106. The differential pressure drives leakage of fluid in direction 422 through leakage gap 434 from a pressure side downstream of blades 204' to a suction side upstream of blades 204'. Leakage gap 434 is formed between leading edge 408 and surface 432 and sized to minimize leakage around fan blade tips 314 without creating a relatively close clearance between fan blade tips 314 and a radial inner surface of first casing segment 414. Rather, a relatively close clearance is formed between leading edge 408 and surface 432 where the probability of fan blade tips 314 inadvertently contacting casing 104 is reduced.

In one embodiment, fan blade 204 is not shortened but rather only machining to cast casing 104 is performed to form surface 432. Alternatively, inner diameter 416, corresponding to the impeller blade 204 location, is enlarged, to increase tip clearance and reduce the risk of interference. Then, to control the increased flow leakage a step in the casing inner diameter 424 is machined in the upstream close to the blade leading edge at the tip. In various embodiments, blades 204' are modified to reduce rotor diameter 418.

An angle θ of the surface 432 is selected for example, to be between 45 and 135 degrees, to realize effective leakage flow turning recirculation and thus optimize fan performance restoration.

In various embodiments, only minor modifications to a machining process of casing 104 are performed and fan rotor 106 is maintained intact at its original size. Thus, only a minimal amount of modifications are required to the current fan configuration.

The above-described embodiments of an assembly and method of forming a casing for a rotatable member provides a cost-effective and reliable means for eliminating or reducing the risk of impeller blade-casing interference, while maintaining fan airflow performance. More specifically, the assembly and method described herein facilitate increasing an inner diameter of the casing in an area of the rotatable member thereby increasing a blade tip gap. In addition, the above-described assembly and method facilitate mitigating an increase in leakage around the blade by reducing a clearance between a leading edge of the blade and the casing using a stepped area close to the blade leading edge. Further, the stepped area tends to facilitate turning any leakage fluid back to the suction side of the rotatable member. As a result, the assembly and method described herein facilitate impeller blade-casing interference, while maintaining fan airflow performance in a cost-effective and reliable manner.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A fan assembly comprising a fan casing including a longitudinal centerline axis extending from an upstream inlet opening to a downstream outlet opening, said assembly comprising:

a rotor comprising a hub and a plurality of rotor blades extending radially outward from said hub, said plurality of rotor blades each comprising a leading edge and a trailing edge in a direction of fluid flow through said fan casing, and a blade tip at a radially distal end of said blade, said tips of said plurality of rotor blades defining a rotor diameter, said rotor configured to rotate about said centerline axis;

a first substantially cylindrical casing segment extending circumferentially about and substantially axially aligned with said blade tips, said first casing segment comprising a first inner diameter that is greater than said rotor diameter;

a second substantially cylindrical casing segment configured to extend axially in a direction opposite a flow of fluid through said fan casing, said second casing segment comprising a second inner diameter, said second inner diameter less than said first inner diameter and said rotor diameter; and a third casing segment extending between said first and second casing segments, said third casing segment comprising the first inner diameter along a first circumferential edge, the second inner diameter along a second circumferential edge, and a surface extending therebetween, said surface is spaced apart from the leading edge of the plurality of blades to form a leakage gap that is less than a difference between said first inner diameter and said rotor diameter.

2. A fan assembly in accordance with claim 1, wherein said fan casing is fabricated unitarily using a casting process.

3. A fan assembly in accordance with claim 1, wherein said fan casing is fabricated from at least one of aluminum and an aluminum alloy.

4. A fan assembly in accordance with claim 1, wherein said surface is conical.

5. A fan assembly in accordance with claim 1, wherein said surface is at least one of convex and concave.

6. A fan assembly in accordance with claim 1, wherein said surface is arcuate.

7. A method of forming a casing for a rotatable member, said method comprising:

forming a first radially inner surface of a first casing segment that is substantially cylindrical about an axis of rotation of the rotatable member and having a first inner diameter, said first inner diameter selected to be greater than an outer diameter of the rotatable member;

forming a second radially inner surface of a second casing segment that is substantially cylindrical about an axis of rotation of the rotatable member and having a second inner diameter, said second inner diameter selected to be less than the outer diameter;

forming a step segment including a first circumferential edge adjacent the first casing segment and a second circumferential edge adjacent the second casing segment and a surface extending between the first edge and the second edge, the first edge having the first inner diameter and the second edge having the second inner diameter; and machining the surface to provide a predetermined gap between the surface and an adjacent leading edge of the rotatable member that is less than a difference between the first inner diameter and the outer diameter of the rotatable member.

8. A method in accordance with claim 7, wherein said forming comprises forming the first, second, and step segments as a single integral unit using a casting process.

9. A method in accordance with claim 7, wherein said forming comprises forming the first, second, and step segments using at least one of an aluminum and an aluminum alloy casting process.

10. A method in accordance with claim 7, further comprising at least one of increasing the first inner diameter of the first casing segment and reducing the outer diameter of the rotatable member to increase a clearance gap between the first casing segment and the rotatable member.

11. A method in accordance with claim 7, wherein forming a step segment comprising machining the surface to a conical contour.

12. A method in accordance with claim 7, wherein forming a step segment comprising machining the surface to an arcuate contour.

13. A fan casing including a longitudinal centerline axis extending from an upstream inlet opening to a downstream outlet opening, said system comprising:

a first substantially cylindrical casing segment configured to extend axially and radially outboard of a path of a blade tip, said first casing segment comprising a first inner diameter;

a second substantially cylindrical casing segment configured to extend axially in a direction opposite a flow of fluid through the fan casing, said second casing segment comprising a second inner diameter, said second inner diameter less than said first inner diameter; and a third casing segment comprising a surface extending between said first and second casing segments, said third casing segment comprising the first inner diameter along a first circumferential edge and the second inner diameter along a second circumferential edge, said surface is spaced apart from the leading edge of the plurality of blades to form a leakage gap that is less than a difference between said first inner diameter and said rotor diameter.

14. A fan casing in accordance with claim 13, wherein said fan casing is fabricated unitarily using a casting process.

15. A fan casing in accordance with claim 13, wherein said fan casing is fabricated from at least one of aluminum and an aluminum alloy.

16. A fan casing in accordance with claim 13, wherein said surface is at least one of arcuate, stepped, and straight in profile.

* * * * *